US008075676B2

(12) United States Patent
Thompson et al.

(10) Patent No.: US 8,075,676 B2
(45) Date of Patent: Dec. 13, 2011

(54) DAMPING APPARATUS FOR SCROLL COMPRESSORS FOR OXYGEN-GENERATING SYSTEMS

(75) Inventors: Loren M. Thompson, Lapeer, MI (US); James E. Nelson, North Branch, MI (US); Robert R. Voltenburg, Jr., Davison, MI (US)

(73) Assignee: Oxus America, Inc., Rochester Hills, MI (US)

( * ) Notice: Subject to any disclaimer, the term of this patent is extended or adjusted under 35 U.S.C. 154(b) by 209 days.

(21) Appl. No.: 12/390,677

(22) Filed: Feb. 23, 2009

(65) Prior Publication Data

US 2009/0214370 A1 Aug. 27, 2009

Related U.S. Application Data

(60) Provisional application No. 61/066,660, filed on Feb. 22, 2008.

(51) Int. Cl.
*F01C 1/02* (2006.01)
*B01D 53/04* (2006.01)

(52) U.S. Cl. ..... 96/121; 96/380; 418/55.1; 418/55.3

(58) Field of Classification Search ..... 96/108, 96/121, 380, 381; 95/130; 418/55.1, 55.3; 128/204.18, 205.12, 205.27
See application file for complete search history.

(56) References Cited

U.S. PATENT DOCUMENTS 3,280,536 A 10/1966 Berlin
3,675,649 A 7/1972 Basham et al.
3,923,477 A 12/1975 Armond et al.
3,957,463 A 5/1976 Drissel et al.
4,013,429 A 3/1977 Sircar et al.
4,065,272 A 12/1977 Armond
4,066,423 A 1/1978 McGill et al.
4,129,424 A 12/1978 Armond
4,182,599 A 1/1980 Eyrick et al.
4,376,640 A 3/1983 Vo
4,378,982 A 4/1983 McCombs
4,421,531 A 12/1983 Dalton, Jr. et al.
4,449,990 A 5/1984 Tedford, Jr.
4,477,264 A 10/1984 Kratz et al.
4,481,944 A 11/1984 Bunnell
4,516,424 A 5/1985 Rowland
4,576,614 A 3/1986 Armond et al.
4,648,888 A 3/1987 Rowland
4,715,867 A 12/1987 Vo
4,758,252 A 7/1988 Lerner et al.
4,810,265 A 3/1989 Lagree et al.
4,816,039 A 3/1989 Krishnamurthy et al.
4,917,710 A 4/1990 Haruma et al.
4,971,049 A 11/1990 Rotariu et al.
4,971,609 A 11/1990 Pawlos
5,099,837 A 3/1992 Russell, Sr. et al.
5,122,164 A 6/1992 Hirooka et al.
5,156,657 A 10/1992 Jain et al.
(Continued)

*Primary Examiner* — Frank Lawrence, Jr.
(74) *Attorney, Agent, or Firm* — Young Basile Hanlon & MacFarlane, P.C.

(57) ABSTRACT

A radially compliant scroll compressor includes a fixed scroll, an orbiting scroll operatively connected to the fixed scroll, a synchronizer and at least one linkage member operatively connected to the orbiting scroll and the synchronizer. The at least one linkage member includes an orbiting crank handle operatively disposed on the linkage member, a crankpin operatively disposed through said synchronizer and extending into the crank handle and a damping member disposed on the crankpin between the synchronizer and the crank handle.

14 Claims, 3 Drawing Sheets

U.S. PATENT DOCUMENTS

| | | | | |
|---|---|---|---|---|
| 5,165,397 | A | 11/1992 | Arp | |
| 5,203,887 | A | 4/1993 | Toussaint | |
| 5,228,888 | A | 7/1993 | Gmelin et al. | |
| 5,294,247 | A | 3/1994 | Scharpf et al. | |
| 5,370,112 | A | 12/1994 | Perkins et al. | |
| 5,429,664 | A | 7/1995 | Lee et al. | |
| 5,429,666 | A | 7/1995 | Agrawal et al. | |
| 5,489,198 | A * | 2/1996 | Comparin et al. | 418/55.5 |
| 5,518,526 | A | 5/1996 | Baksh et al. | |
| 5,531,807 | A | 7/1996 | McCombs | |
| 5,551,852 | A * | 9/1996 | Saito et al. | 418/98 |
| 5,558,086 | A | 9/1996 | Smith et al. | |
| 5,578,115 | A | 11/1996 | Cole | |
| 5,603,315 | A | 2/1997 | Sasso, Jr. | |
| 5,632,268 | A | 5/1997 | Ellis et al. | |
| 5,660,171 | A | 8/1997 | Kimm et al. | |
| 5,685,318 | A | 11/1997 | Elghazzawi | |
| 5,704,964 | A | 1/1998 | Kaneko et al. | |
| 5,706,801 | A | 1/1998 | Rames et al. | |
| 5,755,224 | A | 5/1998 | Good et al. | |
| 5,755,856 | A | 5/1998 | Miyake et al. | |
| 5,766,310 | A | 6/1998 | Cramer | |
| 5,779,767 | A | 7/1998 | Golden et al. | |
| 5,827,358 | A | 10/1998 | Kulish et al. | |
| 5,858,062 | A | 1/1999 | McCulloh et al. | |
| 5,865,174 | A | 2/1999 | Kloeppel | |
| 5,871,564 | A | 2/1999 | McCombs | |
| 5,890,490 | A | 4/1999 | Alysworth et al. | |
| 5,893,944 | A | 4/1999 | Dong | |
| 5,906,672 | A | 5/1999 | Michaels et al. | |
| 5,912,426 | A | 6/1999 | Smolarek et al. | |
| 5,917,135 | A | 6/1999 | Michaels et al. | |
| 5,935,297 | A | 8/1999 | Amlinger | |
| 5,989,315 | A | 11/1999 | Stuart et al. | |
| 6,010,555 | A | 1/2000 | Smolarek et al. | |
| 6,045,603 | A | 4/2000 | Chen et al. | |
| 6,126,721 | A | 10/2000 | Nemser et al. | |
| 6,143,056 | A | 11/2000 | Smolarek et al. | |
| 6,152,134 | A | 11/2000 | Webber et al. | |
| 6,190,441 | B1 | 2/2001 | Czabala et al. | |
| 6,193,785 | B1 | 2/2001 | Huf | |
| 6,220,244 | B1 | 4/2001 | McLaughlin | |
| 6,245,127 | B1 | 6/2001 | Kane et al. | |
| 6,302,107 | B1 | 10/2001 | Richey, II et al. | |
| 6,344,069 | B2 | 2/2002 | Smolarek et al. | |
| 6,345,966 | B1 * | 2/2002 | Hahn et al. | 418/55.1 |
| 6,346,139 | B1 | 2/2002 | Czabala | |
| 6,348,082 | B1 | 2/2002 | Murdoch et al. | |
| 6,372,026 | B1 | 4/2002 | Takemasa et al. | |
| 6,394,089 | B1 | 5/2002 | Cantrill et al. | |
| 6,427,690 | B1 | 8/2002 | McCombs et al. | |
| 6,446,630 | B1 | 9/2002 | Todd, Jr. | |
| 6,461,410 | B1 | 10/2002 | Abe et al. | |
| 6,471,744 | B1 | 10/2002 | Hill | |
| 6,478,850 | B1 | 11/2002 | Warren | |
| 6,478,857 | B2 | 11/2002 | Czabala | |
| 6,511,526 | B2 | 1/2003 | Jagger et al. | |
| 6,520,176 | B1 | 2/2003 | Dubois et al. | |
| 6,524,370 | B2 | 2/2003 | Maheshwary et al. | |
| 6,536,431 | B1 | 3/2003 | Simler | |
| 6,547,851 | B2 | 4/2003 | Warren | |
| 6,551,384 | B1 | 4/2003 | Ackley et al. | |
| 6,558,451 | B2 | 5/2003 | McCombs et al. | |
| 6,622,726 | B1 | 9/2003 | Du | |
| 6,629,525 | B2 | 10/2003 | Hill et al. | |
| 6,641,644 | B2 | 11/2003 | Jagger et al. | |
| 6,641,645 | B1 | 11/2003 | Lee et al. | |
| 6,651,658 | B1 | 11/2003 | Hill et al. | |
| 6,675,798 | B1 | 1/2004 | Tyomkin et al. | |
| 6,691,702 | B2 | 2/2004 | Appel et al. | |
| 6,712,087 | B2 | 3/2004 | Hill et al. | |
| 6,712,877 | B2 | 3/2004 | Cao et al. | |
| 6,764,534 | B2 | 7/2004 | McCombs et al. | |
| 6,793,719 | B2 | 9/2004 | Kim et al. | |
| 6,811,590 | B2 | 11/2004 | Lee et al. | |
| 6,823,866 | B2 | 11/2004 | Jafari et al. | |
| 6,837,244 | B2 | 1/2005 | Yagi et al. | |
| 6,878,186 | B2 | 4/2005 | Neary | |
| 6,949,133 | B2 | 9/2005 | McCombs et al. | |
| 6,962,654 | B2 | 11/2005 | Arnaud | |
| 7,017,575 | B2 | 3/2006 | Yagi et al. | |
| 7,066,985 | B2 | 6/2006 | Deane et al. | |
| 7,077,133 | B2 | 7/2006 | Yagi et al. | |
| 7,104,771 | B2 | 9/2006 | Choi et al. | |
| 7,105,038 | B2 | 9/2006 | Lee et al. | |
| 7,121,276 | B2 | 10/2006 | Jagger et al. | |
| 7,150,280 | B2 | 12/2006 | Aylsworth et al. | |
| 7,156,900 | B2 | 1/2007 | Moeller et al. | |
| 7,171,963 | B2 | 2/2007 | Jagger et al. | |
| 7,188,621 | B2 | 3/2007 | DeVries et al. | |
| 7,204,249 | B1 | 4/2007 | Richey, II et al. | |
| 7,250,073 | B2 | 7/2007 | Keefer et al. | |
| 7,255,105 | B2 | 8/2007 | Figley et al. | |
| 7,264,647 | B2 | 9/2007 | Meckes et al. | |
| 7,273,051 | B2 | 9/2007 | Whitley et al. | |
| 7,279,029 | B2 | 10/2007 | Occhialini et al. | |
| 7,296,573 | B2 | 11/2007 | Estes et al. | |
| 7,300,497 | B2 | 11/2007 | Urakami et al. | |
| RE40,006 | E | 1/2008 | Keefer et al. | |
| 2003/0051730 | A1 | 3/2003 | Theuner | |
| 2003/0140924 | A1 | 7/2003 | Aylsworth et al. | |
| 2003/0145852 | A1 | 8/2003 | Schmidt et al. | |
| 2003/0196550 | A1 | 10/2003 | Keefer et al. | |
| 2004/0074496 | A1 | 4/2004 | Hayashi et al. | |
| 2005/0072423 | A1 | 4/2005 | Deane et al. | |
| 2005/0072426 | A1 | 4/2005 | Deane et al. | |
| 2005/0103341 | A1 | 5/2005 | Deane et al. | |
| 2005/0103342 | A1 | 5/2005 | Jorczak et al. | |
| 2005/0121033 | A1 | 6/2005 | Starr et al. | |
| 2005/0126571 | A1 | 6/2005 | Jorczak et al. | |
| 2005/0217668 | A1 | 10/2005 | Figley et al. | |
| 2005/0268913 | A1 | 12/2005 | Morris et al. | |
| 2005/0274381 | A1 | 12/2005 | Deane et al. | |
| 2006/0027235 | A1 | 2/2006 | Orwig | |
| 2006/0102181 | A1 | 5/2006 | McCombs et al. | |
| 2006/0117957 | A1 | 6/2006 | McCombs et al. | |
| 2006/0137522 | A1 * | 6/2006 | Nishimura et al. | 95/96 |
| 2006/0150972 | A1 | 7/2006 | Mizuta et al. | |
| 2006/0162565 | A1 | 7/2006 | Lee | |
| 2006/0169140 | A1 | 8/2006 | Lomax, Jr. et al. | |
| 2006/0174871 | A1 | 8/2006 | Jagger et al. | |
| 2006/0174872 | A1 | 8/2006 | Jagger et al. | |
| 2006/0174874 | A1 | 8/2006 | Jagger et al. | |
| 2006/0174882 | A1 | 8/2006 | Jagger et al. | |
| 2006/0185668 | A1 | 8/2006 | Jagger et al. | |
| 2006/0230924 | A1 | 10/2006 | Deane et al. | |
| 2006/0230929 | A1 | 10/2006 | Bliss et al. | |
| 2006/0230931 | A1 | 10/2006 | Bliss et al. | |
| 2006/0230939 | A1 | 10/2006 | Bliss et al. | |
| 2006/0266357 | A1 | 11/2006 | McCombs et al. | |
| 2006/0283325 | A1 | 12/2006 | Sugano | |
| 2007/0006880 | A1 | 1/2007 | Smith et al. | |
| 2007/0023039 | A1 | 2/2007 | Ishizaki et al. | |
| 2007/0056584 | A1 | 3/2007 | Jagger et al. | |
| 2007/0095208 | A1 | 5/2007 | Baksh et al. | |
| 2007/0204748 | A1 | 9/2007 | Lomax, Jr. et al. | |
| 2007/0214960 | A1 | 9/2007 | Aylsworth et al. | |
| 2007/0227354 | A1 | 10/2007 | Song | |
| 2007/0283807 | A1 | 12/2007 | Whitley | |
| 2007/0283959 | A1 | 12/2007 | Rassloff | |
| 2008/0000475 | A1 | 1/2008 | Hill | |
| 2008/0006151 | A1 | 1/2008 | Baksh et al. | |
| 2008/0087170 | A1 * | 4/2008 | Deane et al. | 96/399 |
| 2009/0211443 | A1 * | 8/2009 | Youngblood et al. | 95/101 |
| 2010/0071698 | A1 * | 3/2010 | Kiritake | 128/205.27 |

* cited by examiner

DAMPING APPARATUS FOR SCROLL COMPRESSORS FOR OXYGEN-GENERATING SYSTEMS

CROSS REFERENCE TO RELATED APPLICATIONS

This application claims priority to U.S. Provisional Application Ser. No. 61/066,660, filed Feb. 22, 2008, the disclosure of which is incorporated by reference herein in its entirety.

BACKGROUND OF THE INVENTION

The present disclosure relates generally to oxygen generating devices and, more particularly, to a damping member for a scroll compressor in a portable oxygen concentrator.

A portable oxygen concentrating or generating system presents unique problems. It is intended to be easily movable so that it can be easily carried about by a user, since the portability aspect of the invention improves the lifestyle of a person who requires oxygen. This is significantly different than typical non-portable oxygen concentrating systems, such as those used to fill oxygen tanks—where the only portable aspect is the tank itself. As such, a portable oxygen generating device must be capable of function in diverse environments and be relatively lightweight. A portable oxygen generating device must also be in a small package suitable for portability and it should control noise, since it will be contiguous with the patient or user of the device.

In many such oxygen generating devices, as well as in other devices, scroll compressors are used since the packaging is small, and they are relatively lightweight. In certain instances, components of the scroll compressors may, due to their continuous functioning, become undesirably noisy, begin to vibrate or become unstable.

SUMMARY OF THE INVENTION

A radially compliant scroll compressor is provided. It includes a fixed scroll, an orbiting scroll operatively connected to the fixed scroll, a synchronizer and at least one linkage member operatively connected to the orbiting scroll and the synchronizer. The at least one linkage member includes an orbiting crank handle operatively disposed on the linkage member, a crankpin operatively disposed through said synchronizer and extending into the crank handle and a damping member disposed on the crankpin between the synchronizer and the crank handle. Scroll compressors of the invention may be used in various devices, including but not limited to air conditioning units, and/or any device using air compressors. One example of a device using a scroll compressor is an oxygen generating system/device where the avoidance of vibration and noise is an important feature.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Radially compliant scroll compressors typically employ elaborate linkage systems to provide proper attitude of the orbiting scroll element, while allowing radial and axial degrees of freedom to ensure adequate flute sealing. The present inventors have found that the linkage and orbiting scroll element can oscillate and/or become unstable during operation. Embodiments of the present disclosure address this problem by providing system damping.

Figure 1:
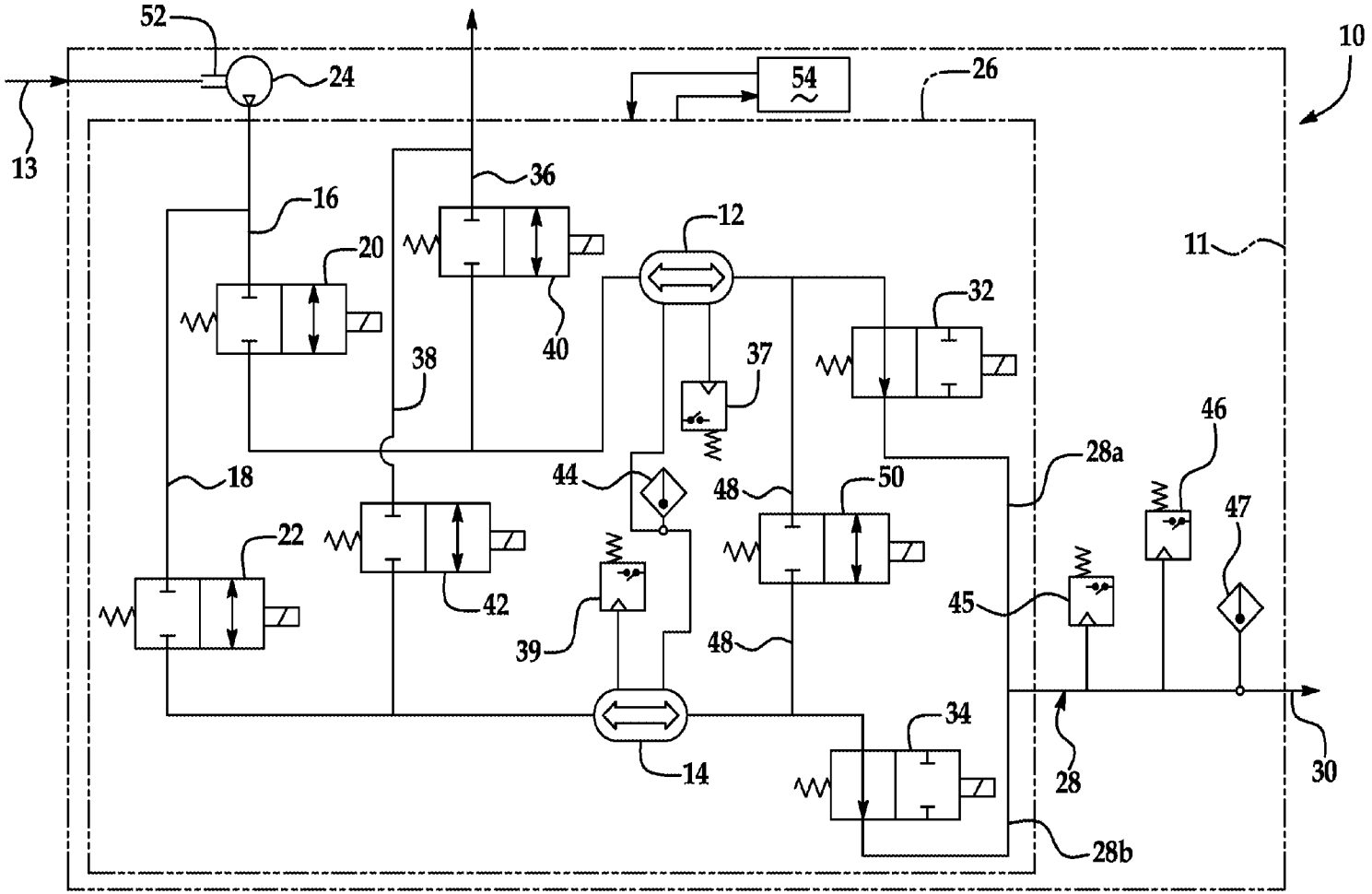
FIG. 1 is a schematic diagram of an example of oxygen generating device in which a scroll compressor of the invention is useful.

One non-limiting example of an oxygen generating system/device suitable for use with embodiment(s) of the method(s) and device(s) disclosed herein is depicted in FIG. 1. However, it is to be understood that any oxygen generating system (or any device using a scroll compressor) may be suitable for use with the embodiments of FIGS. 2 and 3, various examples of which are the oxygen generating system shown or air conditioning units (not shown) or other devices using air compressors (not shown).

Referring now to the drawings, where the invention will be described with reference to specific embodiments without limiting same, and where like numerals are used for like elements, an oxygen generating system or device 10 suitable for use with embodiments of the invention is shown in FIG. 1. It is to be understood that any oxygen generating system may be suitable for use with the scroll compressor of FIGS. 2-4.

The oxygen generating device 10 is portable so that it can be easily carried about by a user. The portability aspect of the invention improves the lifestyle of a person who requires oxygen. In order to provide a portable system, a typical oxygen concentrator, such as those used to fill oxygen tanks is not adequate. Instead, a portable oxygen generating device 10 must be in a small package suitable for portability, it must be lightweight and not vibrate and it should control noise, since it will be contiguous with the patient or user of the device.

The oxygen generating device of the present invention includes a housing 11 having an inlet 13 formed therein. The inlet is configured to receive a feed gas from the ambient atmosphere, the feed gas including at least oxygen and nitrogen. The oxygen generating device also includes at least one sieve bed. In the example shown in FIG. 1, the oxygen generating device 10 includes a first sieve bed 12 and a second sieve bed 14, each in selective fluid communication with the feed gas. In an embodiment, each of the first and second sieve beds 12, 14 are configured to selectively receive the feed gas during a predetermined supply period. The first and second sieve beds 12, 14 receives the feed gas via first and second supply conduits 16, 18, respectively.

The first and second supply conduits 16, 18 are generally operatively connected to respective first and second supply valves (or inlet valves) 20, 22. In a non-limiting example, the first and second supply valves 20, 22 are two-way valves. As provided above, the nitrogen-adsorption process employed by the oxygen generating device 10 operates via cycles, where one of the first or second sieve beds 12, 14 vents purge gas (i.e. nitrogen-enriched gas), while the other of the first or second sieve beds 12, 14 delivers oxygen-enriched gas to the user. During the next cycle, the functions of the respective sieve beds 12, 14 switch so that venting occurs from the sieve bed that previously was delivering oxygen-enriched gas, while oxygen enriched gas is delivered from the sieve bed that in the prior cycle was venting. Switching is accomplished by opening the respective feed gas supply valve 20, 22 while the other of the feed gas supply valves 20, 22 is closed. More specifically, when one of the first or second sieve beds 12, 14 is receiving the feed gas, the respective one of the first or second supply valves 20, 22 is in an open position. In this case, the feed gas is prevented from flowing to the other of the first or second sieve beds 12, 14. In an embodiment, the opening and/or closing of the first and second supply valves 20, 22 may be controlled with respect to timing of opening and/or closing and/or with respect to the sequence in which the first and second supply valves 20, 22 are opened and/or closed.

The feed gas is compressed via a scroll compressor 24 prior to entering the first or second supply conduits 16, 18. As shown in FIG. 1, the compressor 24 includes a suction port 52 configured to draw in a stream of the feed gas from the inlet 13. Scroll compressor 24 will be discussed in detail relative to FIGS. 2-4.

After receiving the compressed feed gas, the first and second sieve beds 12, 14 are each configured to separate at least most of the oxygen from the feed gas to produce the oxygen-enriched gas. In an embodiment, the first and second sieve beds 12, 14 each include the nitrogen-adsorption material (e.g., zeolite, other similar suitable materials, and/or the like) configured to adsorb at least nitrogen from the feed gas. As schematically shown in phantom in FIG. 1, the sieve beds 12, 14 are operatively disposed in a housing 11 that includes sieve module 26.

A user conduit 28 having a user outlet 30 is an alternate selective fluid communication with the first and second sieve beds 12, 14. The user conduit 28 may be formed from any suitable material, e.g., at least partially from flexible plastic tubing. In an embodiment, the user conduit 28 is configured substantially in a "Y" shape. As such, the user conduit 28 may have a first conduit portion 28*a* and a second conduit portion 28*b*, which are in communication with the first sieve bed 12 and the second sieve bed 14, respectively, and merge together before reaching the user outlet 30. The user outlet 30 is an opening in the user conduit 28 configured to output the substantially oxygen-enriched gas for use by the patient. The user outlet 30 may additionally be configured with a nasal cannula, a respiratory mask, or any other suitable device (not shown), as desired.

In the embodiment shown in FIG. 1, the oxygen generating device 10 also includes a sieve bed pressure sensor 37, 39 for the sieve beds 12, 14, respectively, and a sieve bed temperature sensor 44 configured to measure the pressure and temperature, respectively, of the first and second sieve beds 12, 14 during the PSA process. It will be appreciated that a single pressure sensor may also be used to measure the pressure of each of the sieve beds 12, 14. The oxygen generating device 10 further includes an ambient pressure sensor 45 and an ambient temperature sensor 47 to measure the pressure and temperature, respectively, of the ambient environment.

At least the compressor 24, the first and second supply valves 20, 22, and the first and second patient (or user) delivery valves 32, 34 are controlled by a controller 54. The sieve bed pressure sensors 37, 39, the sieve bed temperature sensor 44, the ambient pressure sensor 45, and the ambient temperature sensor 47 measure parameters that are inputs to the controller 54. In a non-limiting example, the controller 54 is a microprocessor including a memory.

A motor 56 drives the components of the oxygen generating device 10 including the compressor 24, the sieve beds 12, 14, the controller 54, the valves 20, 22, 32, 34, 40, 42, and the sensors 37, 39, 44, 45, 47. The motor 56 is powered by a battery (not shown) located on the exterior of the housing 11. In a non-limiting example, the motor 56 is a DC brushless, three-phase motor.

The first conduit portion 28*a* and the second conduit portion 28*b* may be configured with a first user delivery valve 32 and a second user delivery valve 34, respectively. In the embodiment shown, the first and the second user valves 32, 34 are configured as two-way valves. Thus, it is contemplated that when the oxygen-enriched gas is delivered from one of the first and second sieve beds 12, 14, to the user conduit 28, the respective one of the first or second user valves 32, 34 is open. When the respective one of the first or second user valves 32, 34 is open, the respective one of the first or second feed gas supply valves 20, 22 is closed.

The nitrogen-adsorption process selectively adsorbs at least nitrogen from the feed gas. Generally, the compressed feed gas is introduced into one of the first or the second sieve beds 12, 14, thereby pressurizing the respective first or second sieve bed 12, 14. Nitrogen and possibly other components present in the feed gas are adsorbed by the nitrogen-adsorption material disposed in the respective first or second sieve bed 12, 14 during an appropriate PSA/VPSA cycle. The pressure of respective first or second sieve beds 12, 14 is released based upon a suitable trigger. At this point, the nitrogen-enriched gas (including any other adsorbed components) is also released from the respective first or second sieve bed 12, 14 and is vented out of the oxygen generating device 10 through a vent conduit for the respective first or second sieve bed 12, 14.

As shown in FIG. 1, the nitrogen-enriched gas in the first sieve bed 12 is vented through the vent port/conduit 36 when a first vent valve 40 is open, and the nitrogen-enriched gas in the second sieve bed 14 is vented through the vent conduit 38 when a second vent valve 42 is open. It is to be understood that venting occurs after each oxygen delivery phase and after counterfilling, each described further hereinbelow. The gas not adsorbed by the nitrogen-adsorption material (i.e., the oxygen-enriched gas) is delivered to the patient/user through the user outlet 30.

In one embodiment, delivery of the oxygen-enriched gas occurs during or within a predetermined amount of time (i.e., a masked time) after the oxygen delivery phase from the respective first or second sieve bed 12, 14. For example, the oxygen generating device 10 may be configured to trigger an output of a predetermined volume of the oxygen-enriched gas from the first sieve bed 12 upon detection of an inhalation by the user. Detection of an inhalation may be accomplished any number of ways. In the embodiment shown in FIG. 1, a breath detection device 46 is used. The predetermined volume, which is at least a portion of the oxygen-enriched gas produced, is output through the user conduit 28 and to the user outlet 30 during an oxygen delivery phase.

Since a predetermined volume of gas is delivered to the user, it is contemplated that at least a portion of the oxygen enriched gas will not be delivered to the user during or after the masked time to the user outlet 30. The first and second sieve beds 12, 14 are configured to transmit that "left-over" oxygen enriched gas, if any, to the other of the first or second sieve bed 12, 14. This also occurs after each respective oxygen delivery phase. The portion of the remaining oxygen-enriched gas is transmitted via a counterfill flow conduit 48. The transmission of the remaining portion of the oxygen-enriched gas from one of the first or second sieve beds 12, 14 to the other first or second sieve beds 12, 14 may be referred to as "counterfilling." As shown in FIG. 1, the counterfill flow conduit 48 is configured with a counterfill flow valve 50. In a non-limiting example, the counterfill flow valve 50 is a two-way valve. The counterfill flow valve 50 is opened to allow the counterfilling of the respective first and second sieve beds 12, 14.

Figure 2:
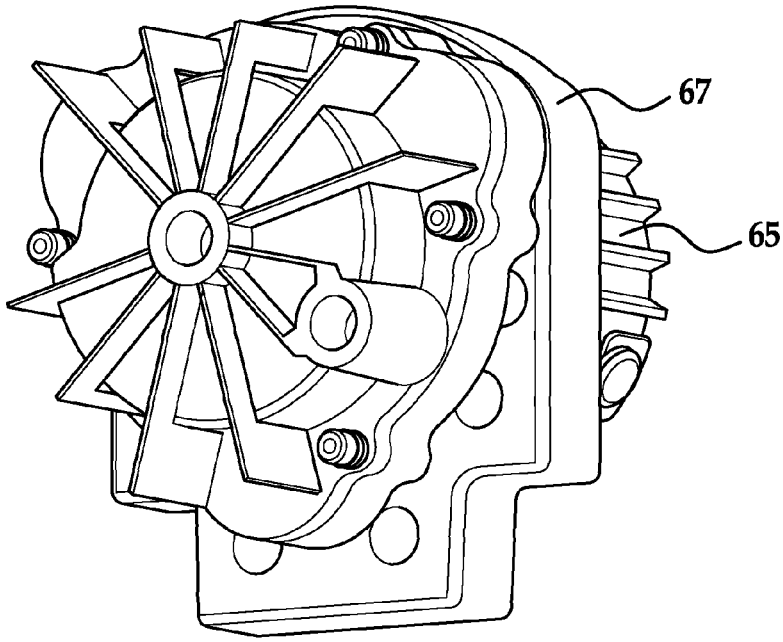
FIG. 2 is a scroll compressor of the invention.
Figure 3:
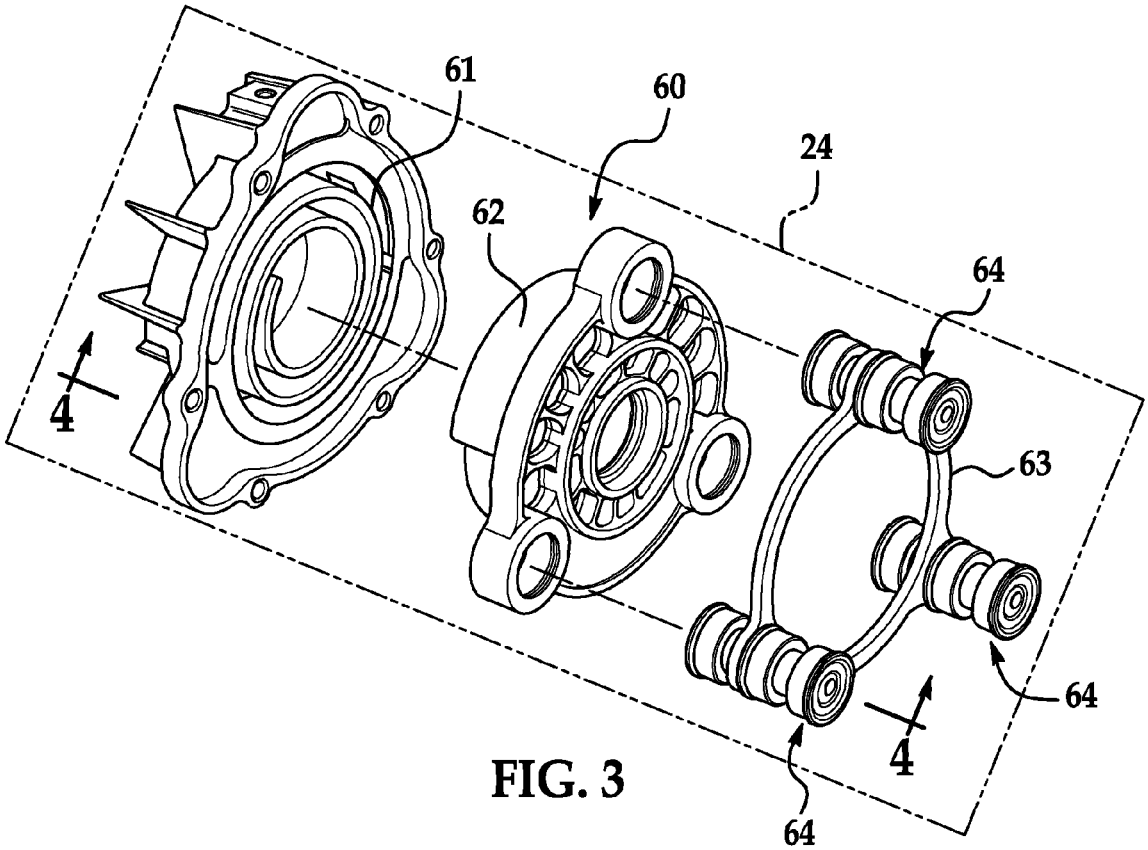
FIG. 3 is an exploded perspective view of the scroll compressor of FIG. 2.
Figure 4:
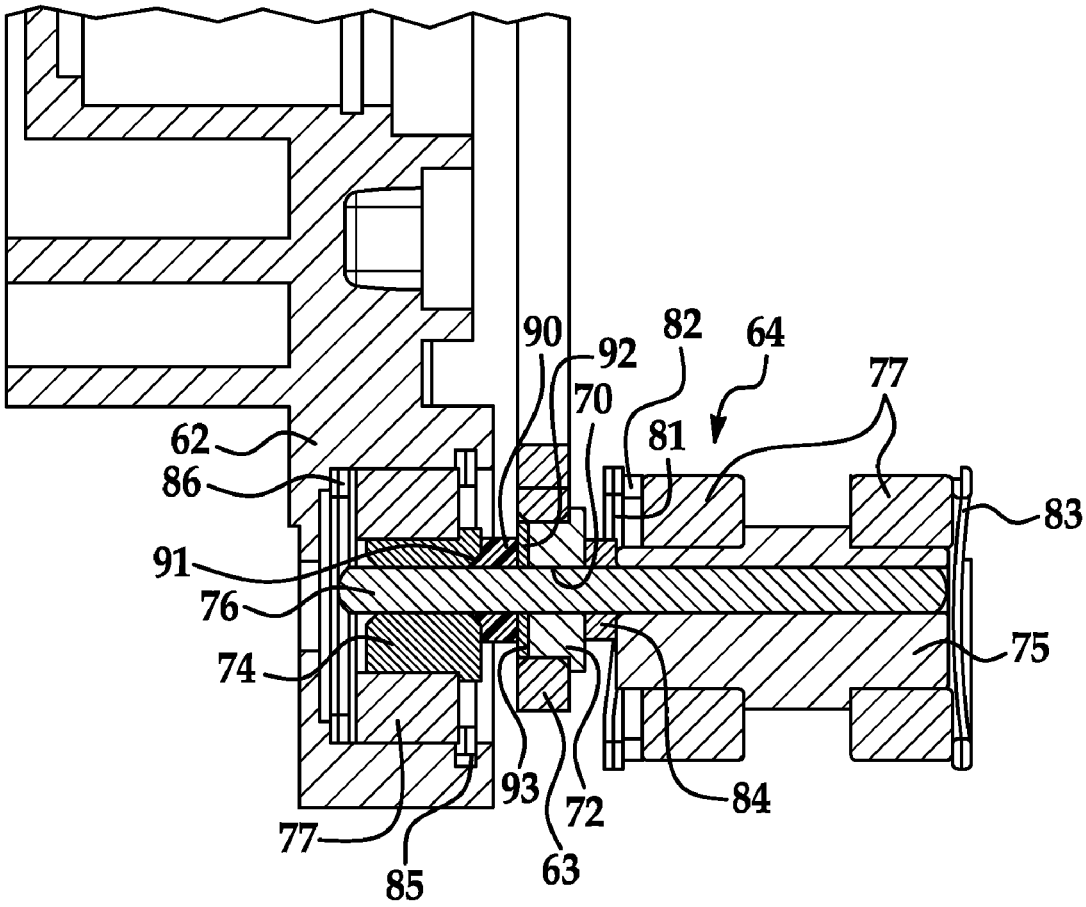
FIG. 4 is a cross-sectional view taken along line 4-4 of FIG. 3.

Referring now to FIGS. 2, 3 and 4, a radially compliant scroll compressor 24 is shown. The scroll compressor 24 includes an orbiting scroll linkage system 60 that includes a fixed scroll 61, an orbiting scroll 62 in contact with the fixed scroll, a synchronizer 63 and linkage members 64 operatively connected to the orbiting scroll 62 and the synchronizer 63. The Orbiting scroll 62 and linkage system 60 is driven by the motor sub-assembly 65, with an eccentric drive shaft (not shown) which interfaces with the center bore of the orbiting scroll 62.

Each linkage member 64 includes a crankpin-receiving bore 70 extending axially through a synchronizer bearing 72 disposed within synchronizer 63. An orbiting crank handle 74 is disposed on each linkage member 64, and a crankpin 76 is operatively disposed in the bore 70 and extends into the sliding journal of crank handle 74. The crank handle 74 is disposed in the orbiting scroll 62 through a bearing component 77. Axial preload is applied to bearing 77 thru spring 86 and retaining ring 85, both located within each bore of the orbiting scroll 62. Crankpin 76 is press fit into crankshaft 75. Together, crankpin 76 and crankshaft 75 provide an eccentric movement of crankpin 76 about the centerline of crankshaft 75 and are retained by bearings 77. A retaining ring 81 and pre-load spring 82 at one end of crankshaft 75, together with a clip 83, keeps the crankshaft 75 stack together within a motor base bore (not shown). Abutting between retaining ring 81 and the synchronizer bearing 72 is a nylon spacer 84 which ensures synchronizer 63 has ample clearance to orbit within the assembly.

Located between orbiting crank handle 74 and synchronizer bearing 72 is an elastic damping member 90 having a first face 91 and a second face 92. Damping member 90 is friction fit on the outer diameter of crankpin 76. Also shown in the embodiment is a shim ring 93 abutting second face 92 of damping member 90 and synchronizer bearing 72. First face 91 of damping member 90 is in face contact with orbiting crank handle 74. Damping member 90 and the geometry thereof is configured to prevent instabilities of motion of the orbiting scroll and linkage system 60.

The operation of compressor 24 will now be described. Due to centripetal acceleration, the motor shaft "slings" the orbiting scroll 62 through an orbit until flute-flute contact occurs with the fixed scroll 61. The orbit radius is defined by the flute-flute contact with the fixed scroll 61. Crankshaft assembly (comprising crankpin 76 and crankshaft 75), synchronizer 63, orbiting crank handle 74 and orbiting scroll knuckle assembly (not shown) allow radial movement of the orbiting scroll 62 to occur throughout orbit while preventing undesirable orbiting scroll 62 rotation about the scroll centroid.

The crank handle 74 and crankpin 76 of linkage member 64 allows the radial compliance of the orbiting scroll 62 by changing their "effective" length. To allow proper kinematic motion, the linkage components must change their angular position relative to their ideal location. The synchronizer 63 substantially ensures that the angular position of all crankpins 76 remain in "time." Relative angular movement within the linkage member 64 occur throughout the orbit and are controlled to prevent oscillation thru the use of damping member 90.

Radially compliant scroll compressors typically oscillate and/or become unstable during operation. Instabilities of the orbiting scroll linkage system 64 and orbiting scroll 62 may cause noise vibration or harshness, as well as a reduction in discharge flow quality. An orbiting scroll 62 path is allowed to compensate for the fixed scroll 61 position in the radial direction. Radial compliance, i.e. flute contact between scrolls of the fixed scroll 61 and the orbiting scroll 62 is necessary between scrolls for a proper gas seal.

Without the invention that includes damping member 90, any cyclic deviation of linkage geometry and/or scroll position will lead to the scroll linkage system 60 into undesirable activity, such as noise vibration or harshness.

Specifically, as compressor 24 operates, resultant tangential loads on the orbiting scroll 62 tend to induce rotation. Linkage members 64 keep orbiting scroll 62 in a confined attitude in space. Damping member 90 provides radial damping and acts as a spring in the axial direction to provide noise and vibration reduction in compressor 24. The silicone damping member 90 frictionally "wipes" the crank handle 74 and crankpin 76 to provide system damping within the linkage members 64. The damping reduces undesirable oscillation, noise, vibration, harshness, and flow instabilities.

This improvement is especially important in the environment of an oxygen generating device 10, which is attached to a patient or user. Any noise or vibration of the compressor 24 translates to an undesirable oxygen concentrating product. An oxygen concentrating product is always contiguous with the user and, as such, the product must be capable of being used in any environment which the patient finds him or herself in—including those in which noise and vibration are not acceptable.

It is to be understood that the damping member 78 may be of any suitable size, shape, configuration, and formed from any suitable materials. In an example, the damping member 90 is a washer formed from silicone.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A scroll compressor comprising:

a fixed scroll;

an orbiting scroll operatively connected to said fixed scroll;

a synchronizer; and at least one linkage member operatively connected to said orbiting scroll and said synchronizer, said at least one linkage member including:

an orbiting crank handle operatively disposed on said linkage member;

a crankpin operatively disposed through said synchronizer and extending into said crank handle; and a damping member operatively disposed on said crankpin, between said synchronizer and said crank handle.

2. The scroll compressor of claim 1, wherein said damping member is a silicone washer.

3. The scroll compressor of claim 1, wherein said synchronizer includes at least one bearing disposed therein, said crankpin extending through a bore in said bearing and a shim ring disposed between said at least one bearing and said damping member.

4. The scroll compressor of claim 3, wherein said damping member includes two opposite faces, one of said faces bears against said shim ring, and the other of said faces bears against said crank handle.

5. The scroll compressor of claim 4, wherein said other of said faces includes a protrusion extending therefrom and toward said crank handle.

6. The scroll compressor of claim 5, wherein said damping member is a silicone washer.

7. The scroll compressor of claim 1, including:

at least three linkage members operatively connected to said orbiting scroll and said synchronizer, each of said at least three linkage members including an orbiting crank handle operatively disposed on said linkage member;

a crankpin operatively disposed through said synchronizer and extending into said crank handle; and a damping member operatively disposed on said crankpin, between said synchronizer and said crank handle.

8. An oxygen generating system, comprising:

a housing having an inlet configured to receive a feed gas;

a scroll compressor for compressing said feed gas;

at lease one sieve bed within said housing, said sieve bed including a nitrogen- adsorbing material configured to adsorb at least a portion of a nitrogen gas from said compressed feed gas introduced thereto to generate an oxygen enriched gas;

said scroll compressor including a fixed scroll; an orbiting scroll operatively connected to said fixed scroll;

a synchronizer; and at least one linkage member operatively connected to said orbiting scroll, and said synchronizer, said at least one linkage member including: an orbiting crank handle operatively disposed on said linkage member;

a crankpin operatively disposed through said synchronizer and extending into said crank handle; and a damping member operatively disposed on said crankpin, between said synchronizer and said crank handle.

9. The oxygen generating system of claim 8, wherein said damping member is a silicone washer.

10. The oxygen generating system of claim 8, wherein said synchronizer includes at least one bearing disposed therein, said crankpin extending through a bore in said bearing and a shim ring disposed between said at least one bearing and said damping member.

11. The oxygen generating system of claim 10, wherein said damping member includes two opposite faces, one of said faces bears against said shim ring and the other of said faces bears against said crank handle.

12. The oxygen generating system of claim 11, wherein said other of said faces includes a protrusion extending therefrom and toward said crank handle.

13. The oxygen generating system of claim 12, wherein said damping member is a silicone washer.

14. The oxygen generating system of claim 8, including:

at least three linkage members operatively connected to said orbiting scroll and said synchronizer, each of said at least three linkage members including an orbiting crank handle operatively disposed on said linkage member;

a crankpin operatively disposed through said synchronizer and extending into said crank handle; and a damping member operatively disposed on said crankpin, between said synchronizer and said crank handle.

* * * * *